United States Patent [19]

Lohrman

[11] 4,280,631

[45] Jul. 28, 1981

[54] SAFETY CLOSURE AND CONTAINER WITH SNAP CAP LINER

[75] Inventor: Richard D. Lohrman, Mundelein, Ill.

[73] Assignee: Owens-Illinois, Inc., Toledo, Ohio

[21] Appl. No.: 128,423

[22] Filed: Mar. 10, 1980

[51] Int. Cl.[3] ..... A61J 1/00; B65D 55/02; B65D 85/56

[52] U.S. Cl. ..... 215/204; 215/216; 215/225; 215/350; 215/330

[58] Field of Search ..... 215/204, 216, 218, 219, 215/224, 225, 318, 295, 330, 350; 220/256

[56] References Cited

U.S. PATENT DOCUMENTS

| | | | |
|---|---|---|---|
| 3,788,510 | 1/1974 | Collins | 215/350 |
| 3,941,268 | 3/1976 | Owens et al. | 215/216 |
| 3,955,696 | 5/1976 | Finke | 215/214 |

*Primary Examiner*—George T. Hall

*Attorney, Agent, or Firm*—John R. Nelson; Myron E. Click; David H. Wilson

[57] ABSTRACT

The invention relates to an improvement in a child resistant liquid seal closure and container combination. The container neck has one or more locking projections which engage one or more locking lugs on the interior surface of the closure to prevent rotational removal of the closure from the container. To remove the closure, the cap skirt must be squeezed and distorted to disengage the lugs radially outwardly from the locking projections on the container neck. A snap cap liner is retained within the closure, adjacent the inside surface of the top panel. As the closure is rotated onto the container, this liner snaps into place onto the top of the container neck, and forms a primary liquid seal. Although the final orientation of the outer closure and bottle is effected by the relative position of the locking lugs and projecting cam, this orientation does not affect the primary seal formed by the internal snap cap liner.

8 Claims, 2 Drawing Figures

SAFETY CLOSURE AND CONTAINER WITH SNAP CAP LINER

BACKGROUND OF THE INVENTION

The invention relates to safety closures for containers of dangerous or harmful contents. To prevent access to contents by young children, removal of such closures requires purposeful manipulation in addition to mere rotation of the closure. One type of safety closure has a top panel and a depending annular skirt. The interior of the skirt is threaded to engage corresponding threads on the exterior of the container neck. The interior of the closure has one or more projecting locking lugs, which engage one or more corresponding locking lugs on the exterior of the container neck. Engagement of the locking lugs prevents the normal rotation necessary to remove the threaded closure from the container. Removal is possible only when the skirt is squeezed and distorted to force the closure locking lugs radially outward from engagement with the neck locking lugs.

Such safety closures, called "squeeze and turn" caps, are known in the prior art. U.S. Pat. Nos. 3,941,268 to Owens, et al. and 4,117,945 to Mumford disclose safety closures and containers which require that the closure be squeezed to disengage locking lugs while the closure is rotated. To form a liquid seal, a compressible liner within the cap has been employed. An effective liquid seal on such prior art closures is achieved when the closure is snugly threadably engaged on the container neck, thereby compressing the liner. To assure both such snug engagement and operation of the locking feature, the threads and lugs must be so aligned in manufacture that after the engagement of the locking lugs the closure may be rotated some small additional increment to finally tighten the closure. To eliminate the necessity for manufacturing precision, a squeeze and turn safety closure whose primary seal does not depend on final rotational orientation of closure to container is obviously desirable.

SUMMARY OF THE INVENTION

The invention comprises a safety closure of the squeeze and turn type, in which the primary seal is formed by a snap cap retained within an outer closure. The snap cap is a separate plastic cap, but is permanently held in position within the outer cap, near the top, by a retention ring. The snap cap is provided with a lower annular snap bead which is formed to engage an annular groove in the outer cylindrical surface of the container neck. As the outer closure is threaded downward onto the container neck, the snap cap is pushed into position around the container neck. A liquid tight seal is formed as the snap bead snaps into the cooperating annular groove in the neck. Since there is clearance between the snap cap and the outer closure panel at the top, and between the snap cap and the retention ring at the bottom, the snap cap is isolated from small rotational movements of the outer enclosure. Therefore, once the snap cap has snapped into place, any additional rotation of the outer closure in either direction necessary to engage the locking lugs will not affect the seal. When the closure is removed, by the "squeeze and turn" technique the retention ring lifts the snap cap off the container along with the outer closure.

DESCRIPTION OF PREFERRED EMBODIMENT

Figure 2:
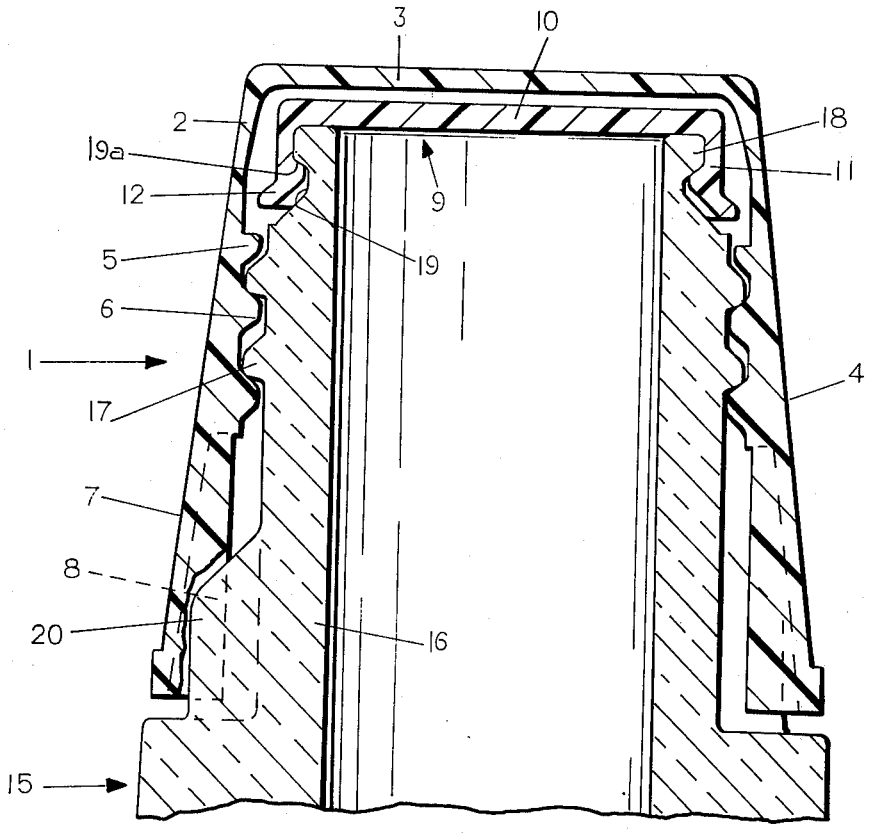
FIG. 2 is a sectional view similar to FIG. 1, but showing the inner snap cap in sealing position on the container neck.

Referring now to the drawings, the invention comprises a safety closure 1 comprising an inner snap cap liner 9 an outer closure 2, and a container 15. The outer closure 2 has a top panel section 3 and an annular skirt section 4 depending from the periphery of the panel 3. On the inside surface of the skirt 4 near the top of the outer closure 2 is an inwardly projecting, annular retention ring 5 which has an inside diameter less than the outside diameter of the snap cap liner 9, but greater than the outside diameter of the container neck 16. Below the retention ring 5, the inside surface of the skirt 4 is of generally cylindrical configuration with threads 6 formed thereon to engage a threaded container neck. Below the threaded section 6 of the skirt 4 is an outwardly tapering relatively thinned walled lower skirt section 7. The lower skirt section 7 has a plurality of integral internally projecting locking lugs 8.

During manufacture, an inner closure, or snap cap liner 9 is press fitted within the outer closure 2, where it is held in place near the top panel 3 by the retention ring 5. The inner snap cap liner 9 is composed of a top panel section 10 and a relatively short annular skirt section 11 depending from the periphery of snap cap liner panel 10. The bottom of the snap cap liner skirt 11 is thickened to form a snap bead 12. After the snap cap liner has been pressed into place in the outer closure 1, the bottom of the snap bead 12 rests against the inwardly projecting retention rib 5.

A container 15 to cooperate with the safety closure 1 has a generally cylindrical neck section 16, with an external threaded section 17 formed to engage the corresponding threads of the outer closure 2. The neck 16 has an annular rim 18 defining a dispensing opening. Immediately below the container rim 18, an annular groove 19 is formed to snugly engage the snap bead 12 of the snap cap liner 9. The upper surface **19*a* of groove 19 is tapered upwardly and outwardly. Projecting from the cylindrical neck section 16, below the threaded section 17, are a plurality of outwardly projecting locking lugs 20. These locking lugs 20 project far enough to engage the corresponding locking lugs 8 on the outer closure 2. The container lugs 20 do not extend far enough to contact the inside surface of the lower tapered skirt section 7, except at the locking lugs 8**.

Figure 1:
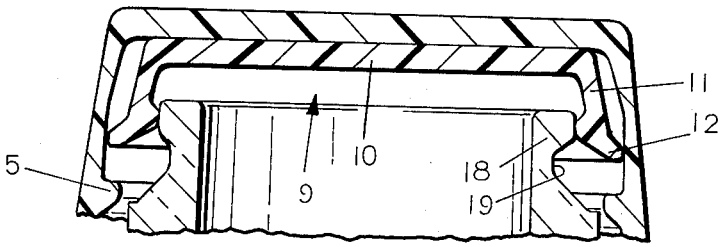
FIG. 1 is a sectional view of a closure and container embodying this invention with the closure partially threaded onto the container.

Referring now specifically to FIG. 2, as the outer closure 2 is threaded onto the container neck 16, the inner snap cap liner 9 is forced by panel 3 into engagement with the neck rim 18. The inside diameter of the snap bead 12 is less than the outside diameter of the rim 18 above the groove 19. As the snap cap liner 9 is pushed onto position therefore, the snap bead 12 is stretched around the rim 18 (FIG. 1). As the snap cap liner 9 is pushed further onto the container rim 18, the groove 19 in the container rim allows the snap bead 12 to snap downwardly and inwardly toward its original unstretched portion, thereby pulling the snap cap liner 9 downwardly and slightly spaced from panel 3 (FIG. 2). Such downward movement results from the taper of the upper surface 19a of a groove 19. The snap cap bead 12 and skirt 11, and the container rim 18 and groove 19 are sized so that the snap cap liner 9 and the rim 18 snugly engage each other to form a liquid seal.

It will be noted that the vertical distance between the outer closure top panel 3 and the retention ring 5 is greater than the vertical height of the inner snap cap liner 9. The liquid seal, therefore, is unaffected by further slight rotation of outer closure 2 in either direction necessary to engage locking lugs 20 and 8. The seal is also unaffected by retro-rotation of the outer closure 2 insufficient to bring the retention ring 5 into contact with the snap bead 12. The container lugs 20 and the closure lugs 8 are so located that they prevent rotation of the outer closure 2 sufficient to bring the retention ring 5 into contact with the snap cap closure 9.

To remove the closure 1 from the container 15, the cap 1 is rotated with appropriate squeezing motions to disengage the locking lugs 8 and 20. As the outer closure 2 is moved upward, the retention ring 5 engages the snap cap liner bead 12 to lift the snap cap liner 9 off the container rim 18. Alternatively, the closure 1 could be constructed without the retention ring 5, and threads 6 could be utilized to retain the snap cap 9.

The disclosed locking feature of the closure functions in the same manner as the locking feature disclosed in U.S. Pat. No. 3,941,268 to Owens and Smalley. In general, as the outer closure 2 is screwed onto the container 15 the locking lugs 8 projecting inwardly from the flexible skirt section 4 are cammed outward by camming surfaces on container lugs 20. When the outer closure 2 is in place, rotation to remove the outer closure 2 is prevented by the engagement of locking lugs 8 and container locking lugs 20. The flexible skirt section 7 must be deformed by pressure at points opposite locking lugs 8, thereby forcing the lugs 8 radially outward, so that lugs 8 and 20 no longer interfere with rotation of the closure 2.

Although the invention has been described in terms of specified embodiments which are set forth in detail, it should be understood that this is by illustration only and that the invention is not necessarily limited thereto, since alternative embodiments will become apparent to those skilled in the art in view of the disclosure. Accordingly, modifications are contemplated which can be made without departing from the spirit of the described invention.

What is claimed is:

1. An improved child resistant safety closure adapted for threadable attachment on a container having a generally cylindrical hollow dispensing end including an externally threaded neck portion, an annular rim defining a dispensing opening, an annular groove adjacent said dispensing opening, and locking means on said container to lock said closure on said dispensing end when said closure is threadably rotated to a fully closed position on said neck portion, said closure comprising: an outer closure having a top panel and an annular skirt portion depending therefrom, said annular skirt including threads on the interior surface thereof adapted to engage the threads of the neck portion of said container and means to releasably engage said container locking means, an inner sealing closure having a top panel section, a depending annular skirt section depending from the periphery of said inner closure panel section, means on said inner closure skirt to snugly engage said annular groove to effect a seal of the container, and means on said outer closure for retaining said inner sealing closure within said outer closure, said last mentioned means permitting a limited axial movement of said outer closure, in either direction without interferring with the sealing engagement of said inner sealing closure and the cotainer annular rim.

2. The closure of claim 1 wherein said means for retaining said inner sealing closure comprises an annular retention ring inwardly projecting from said outer closure skirt section, said retention ring having an inside diameter greater than the outside diameter of the container neck and less than the outside diameter of said inner closure skirt section, said retention ring spaced below said outer closure panel a greater distance than the vertical height of said inner sealing closure, whereby limited axial movement of said outer closure does not axially displace said inner sealing closure.

3. The closure of claim 1, wherein said means for sealingly engaging said inner closure and said container neck comprises a thickened annular bead at the bottom of said inner closure skirt section.

4. The closure of claim 1, 2 or 3 wherein said inner sealing closure comprises a snap cap.

5. In combination, a container and a safety closure, said container comprising a generally cylindrical hollow dispensing end comprising an externally threaded neck section, an annular rim defining a dispensing opening, an annular groove adjacent said dispensing opening between said rim and said threaded portion, and locking means on said container neck to lock said closure on said dispensing end when said closure is threadably rotated to a fully closed position on said container neck; said safety closure comprising an outer closure having a top panel and an annular skirt portion depending therefrom, said annular skirt including threads on the interior surface thereof adapted to engage the threads of said neck section of said container and means to releasably engage said container locking means, on inner sealing closure comprising a top panel section, a depending annular skirt section depending from the periphery of said inner closure panel section, means on said inner closure skirt to snugly engage said annular groove to effect a seal of said container, and means on said outer closure for retaining said inner sealing closure within said outer closure, said last mentioned means permitting a limited axial movement of said outer closure, in either direciton, without interfering with the sealing engagement of said inner sealing closure and said container annular rim.

6. The combination of a container and safety closure of claim 5 wherein said means for retaining said inner sealing closure comprises an annular retention ring inwardly projecting from said outer closure skirt section, said retention ring having an inside diameter greater than the outside diameter of said container neck and less than the outside diameter of said inner closure skirt section, said retention ring spaced below said outer closure panel a greater distance than the vertical height of said inner sealing closure, whereby limited axial movement of said outer closure does not axially displace said inner sealing closure.

7. The combination of a container and safety closure of claim 5, wherein said means for sealingly engaging said inner closure and said container neck comprises a thickened annular bead at the bottom of said inner closure skirt section.

8. The combination of a container and safety closure of claim 7, wherein said annular groove comprises an annular surface tapering upwardly and outwardly toward said container dispensing rim, whereby said inner closure annular bead will snap downwardly and inwardly into engagement with said annular groove.

* * * * *